US007509758B2

(12) United States Patent
Nesseth

(10) Patent No.: US 7,509,758 B2
(45) Date of Patent: Mar. 31, 2009

(54) REVERSIBLE HITCH STRUCTURE FOR LOADER ATTACHMENTS

(75) Inventor: Clinton Nesseth, Cameron, WI (US)

(73) Assignee: NTH Inc., Barron, WI (US)

( * ) Notice: Subject to any disclaimer, the term of this patent is extended or adjusted under 35 U.S.C. 154(b) by 338 days.

(21) Appl. No.: 11/194,108

(22) Filed: Jul. 28, 2005

(65) Prior Publication Data

US 2006/0070759 A1 Apr. 6, 2006

Related U.S. Application Data

(60) Provisional application No. 60/592,800, filed on Jul. 30, 2004.

(51) Int. Cl.
*E02H 5/04* (2006.01)
*E02F 3/76* (2006.01)

(52) U.S. Cl. ..... 37/231; 37/408; 37/267; 172/272; 172/273

(58) Field of Classification Search ..... 37/266, 37/268, 267, 407–410, 449, 231; 414/723; 172/272, 273
See application file for complete search history.

(56) References Cited

U.S. PATENT DOCUMENTS 539,888 A * 5/1895 Yorgey ..... 172/703
2,622,349 A * 12/1952 Kinnan ..... 172/445.2
2,883,772 A * 4/1959 Dodge ..... 37/409
3,059,357 A * 10/1962 Irish ..... 37/449
3,512,665 A * 5/1970 Westendorf ..... 414/723
3,601,203 A * 8/1971 Holmstrom ..... 172/719
3,672,521 A 6/1972 Bauer et al.
3,753,508 A 8/1973 Carpenter
3,851,711 A 12/1974 Stepe
3,941,262 A * 3/1976 Moser et al. ..... 414/722
3,984,016 A 10/1976 Kuhn
3,985,249 A * 10/1976 Aker et al. ..... 414/723
4,013,182 A * 3/1977 Pratt et al. ..... 414/723
4,030,624 A * 6/1977 Matthews ..... 414/723
4,164,821 A 8/1979 Vanchot
4,749,048 A 6/1988 Kelly
4,778,011 A 10/1988 Hutchison
4,837,951 A 6/1989 Verseef (Continued)

OTHER PUBLICATIONS

ATI Corporation, ATI Products, ATI Skid Steer & Tractor Loader Attachments, 3-Point Hitch Quick Attach, http://www.abcgroff.com/ic/ati4a.htm, 2 pages.

*Primary Examiner*—Thomas A Beach
(74) *Attorney, Agent, or Firm*—Merchant & Gould P.C.

(57) ABSTRACT

A hitch structure for mounting attachments to a vehicle such as a skid steer loader is disclosed herein. The hitch structure includes a universal, reversible hitch structure. The hitch structure includes a first end positioned opposite a second end, a fixed locking structure located adjacent each of the first end and the second end, the fixed locking structure constructed for receiving a toe end of an attachment carrier of a loader vehicle. The hitch structure also includes a removable locking structure with a slot for receiving a locking wedge positioned adjacent a heel end of the attachment carrier. The removable locking structure is removably engageable with the hitch structure alternatively adjacent either the first end or the second end of the hitch structure to form a clamping structure with the fixed locking structure located at the opposite end from the removable locking structure for mounting the attachment to the vehicle.

21 Claims, 7 Drawing Sheets

U.S. PATENT DOCUMENTS 5,098,252 A * 3/1992 Sheesley et al. ..... 414/723
5,114,299 A * 5/1992 Roche et al. ..... 414/722
5,224,816 A * 7/1993 Kaczmarczyk et al. ..... 414/723
5,248,000 A 9/1993 Goto et al.
5,252,022 A * 10/1993 Culp et al. ..... 414/723
5,562,398 A * 10/1996 Knutson ..... 414/732
5,590,483 A * 1/1997 Kim ..... 37/468
5,641,157 A 6/1997 Mays et al.
5,685,689 A * 11/1997 Schneider et al. ..... 414/723
5,715,613 A 2/1998 Ebert
5,724,755 A 3/1998 Weagley
5,771,979 A 6/1998 Alanis
5,909,961 A * 6/1999 Pullman ..... 37/444
5,938,399 A * 8/1999 Knutson ..... 414/722
6,070,343 A 6/2000 Sheldon
6,112,438 A 9/2000 Weagley
6,227,792 B1 * 5/2001 Baker et al. ..... 414/723
6,238,130 B1 * 5/2001 Youngers ..... 403/322.4
6,256,910 B1 7/2001 Grozde
6,267,818 B1 7/2001 Volpe, Jr.
6,314,666 B1 11/2001 Klemenhagen et al.
6,360,459 B1 * 3/2002 Brookhart et al. ..... 37/442
6,386,822 B1 * 5/2002 Burr ..... 414/723
6,419,030 B1 7/2002 Turner
6,470,604 B1 10/2002 Foster et al.
6,560,904 B2 5/2003 Guggino
6,604,752 B1 8/2003 Gerres et al.
6,709,224 B2 * 3/2004 Heiple ..... 414/723
2002/0043009 A1 4/2002 Fulton, III
2003/0005605 A1 * 1/2003 Kaczmarski et al. ..... 37/444
2003/0061741 A1 4/2003 Guggino
2005/0193597 A1 * 9/2005 Sutton et al. ..... 37/266
2007/0107271 A1 * 5/2007 Weagley et al. ..... 37/407

* cited by examiner

REVERSIBLE HITCH STRUCTURE FOR LOADER ATTACHMENTS

CROSS REFERENCE TO RELATED APPLICATIONS

This application claims priority from provisional application Ser. No. 60/592,800, filed Jul. 30, 2004, and which is incorporated herein by reference.

FIELD OF THE INVENTION

This invention relates generally to loader attachments for vehicles such as skid steer loaders, tractors, or the like and more particularly to a reversible hitch structure for loader attachments.

BACKGROUND OF THE INVENTION

A wide variety of loader attachments for vehicles such skid steer loaders, tractors or the like are available and in use. Generally, most attachments include a hitch portion and a workpiece portion. The hitch portion of the attachments is used for mounting the attachments to the loader vehicles. The workpiece portion of the attachments are constructed for a variety of uses and may include augurs, backhoes, brooms, buckets, trenchers, cutters, chippers, concrete mixers, crushers, diggers, dozer blades, graders, rakes, pallet forks, snow blowers, tillers, scrapers, clam shells, plows, bale spears, etc. Vehicles such as skid steerers, tractors, or the like typically include a structure at the front end or the back end of the loader for fixedly engaging the loader attachments so that the attachments can be operated and moved, generally by hydraulic power, by the vehicle. Such "hitch" configurations are different from the typical trailer hitch structures used to simply tow or push trailer-type assemblies. Most loader vehicle companies have designed their vehicles to include a universal type structure for engaging a plurality of attachments. One common structure found in the art is what is called a toe-heel attachment carrier that is used to engage the hitch portion of the attachments. Most vehicle companies have also designed their loader attachments with a universal type of a hitch so that they can be used with the toe-heel attachment carriers of vehicles of different manufacturers. In this manner, loader vehicles can use a variety of attachments manufactured by different companies for a variety of purposes, given that the attachment carriers and the hitch structures found on the attachments contain universal counterparts.

Whether it be universal or not, despite the versatile use of front end loader vehicles and the multitude of attachments designed for them, there is no hitch structure in the art that allows reversible coupling of loader attachments to such vehicles. It is conceivable that certain workpieces may be designed to be reversible implements where two sides of the workpiece, e.g., the top and the bottom sides, can be utilized for different purposes. For example, it is conceivable that a plow blade may have a top edge containing rubber material and a bottom edge containing metal material. The rubber edge may serve a different function than the bottom metal edge and reversibility of such a blade allows both edges to be utilized. Reversibility of, for example, a plow blade may also be useful for wear reasons.

However, the art lacks a hitch structure that would allow the reversible use of such an implement. More importantly, the art lacks a reversible hitch structure that can be used with the universal attachment carriers found on most conventional loader vehicles. Thus, only one-sided implements are commonly found in the art.

What is needed in the art is a hitch structure that allows multiple sides of an attachment workpiece to be utilized. More importantly, what is needed in the art is a reversible hitch structure that can be made universal so that it can be used with existing vehicle attachment carriers.

SUMMARY OF THE INVENTION

The invention provides an improved hitch structure used for connecting a loader attachment to a loader vehicle. The loader attachment includes a workpiece portion and a hitch portion. The hitch structure is configured to enable connection of the workpiece to the loader vehicle in either of two orientations, the orientations being 180° from each other, whereby the workpiece can alternatively be used in two or more different orientations.

In certain embodiments, the hitch structure may include a first end positioned opposite a second end, a fixed locking structure located adjacent each of the first end and the second end, the fixed locking structure constructed for receiving a toe end of an attachment carrier of a loader vehicle and a removable locking structure including a slot for receiving a locking wedge positioned adjacent a heel end of the attachment carrier. The removable locking structure is removably engageable to the hitch structure alternatively adjacent either the first end or the second end of the hitch structure and is adapted to form a clamping structure with the fixed locking structure that is located at the opposite end from the removable locking structure.

In certain embodiments, the hitch structure may be universal to accommodate already existing attachment carriers of conventional loader vehicles.

BRIEF DESCRIPTION OF THE DRAWINGS

Referring now to the Drawings, wherein like numerals represent like parts throughout the several views.

DETAILED DESCRIPTION OF THE PREFERRED EMBODIMENT

Figure 1:
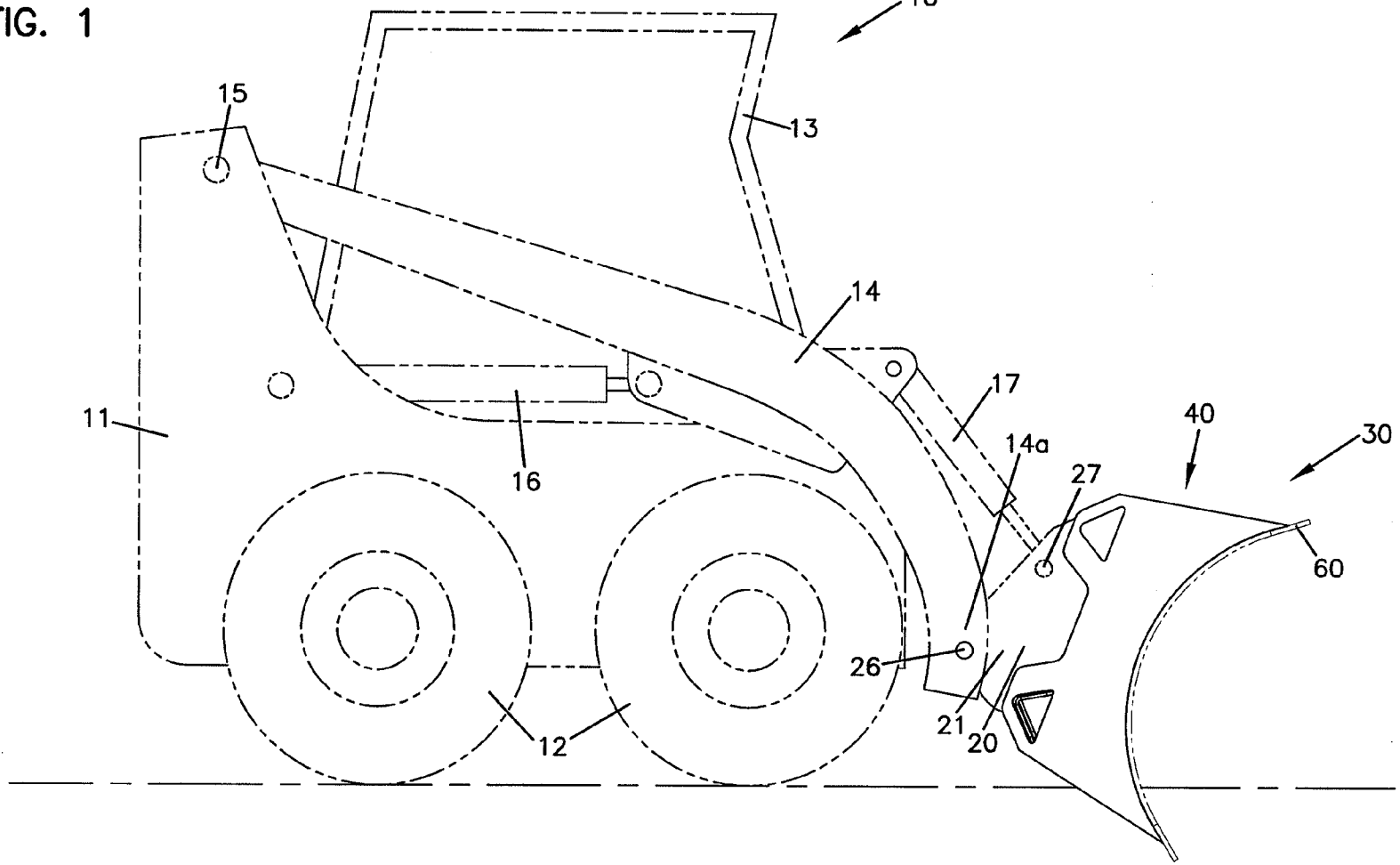
FIG. 1 is a right side elevation view of a skid steer loader vehicle, shown with phantom lines, including a loader attachment, wherein the loader attachment includes a plow blade workpiece, also shown with phantom lines, and a reversible hitch structure incorporating the principles of the invention.

Referring to FIGS. 1-7, there is generally illustrated therein a preferred embodiment of a reversible hitch structure 40 that incorporates the principles of this invention. In FIG. 1, the reversible hitch structure 40 is illustrated as part of a loader attachment 30 that has a plow-blade workpiece 60. The loader attachment 30 is shown attached to and being movable by a skid steer loader vehicle 10. It will be understood that the invention is not limited to use with a skid steer loader vehicle illustrated in FIG. 1, but that the skid steer loader vehicle 10 is simply representative of one embodiment of a vehicle that can be used to practice the principles of this invention.

Referring to FIG. 1, the skid steer loader vehicle 10 generally includes a chassis 11 containing an engine and power train for moving and operating the vehicle. The vehicle includes a plurality of wheels, generally indicated at 12, for moving the vehicle over the ground or support surface. The vehicle 10 typically has a cab portion 13 wherein an operator sits to control the vehicle, and a primary pair of pivotally movable lift arms 14 that can be raised and lowered about their rear pivot positions, generally indicated at 15 to raise and lower the forward ends 14*a* of the operator arms 14 relative to the ground or support surface. A pair of hydraulic lift cylinders 16 provides the motive force for rotatably moving the operator arms 14.

The skid steer loader vehicle 10 also has an attachment mounting structure 20 pivotally connected to the forward ends 14*a* of the operator arms 14 for engaging the loader attachment 30. Attachment mounting structure 20 for engaging the loader attachment 30 is depicted as an attachment carrier 21 that is found on most conventional loader type vehicles. It will be understood that other types of engagement structures may be used on the loader type vehicles for engaging the loader attachments.

The attachment carrier 21 provides detachable mounting and connection to various implements such as the plow-blade workpiece 60 of FIG. 1. The attachment carrier 21 is movable and pivotable relative to the forward ends 14*a* of the operator arms 14 by one or more hydraulic cylinders 17. Cylinders 17 are used to pivot and move the attachment carrier 21 and attached implements relative to the forward ends 14*a* of the operator arms 14.

Illustrative key features for the attachment carrier can take a variety of forms, as well known in the art and as, for example, illustrated in U.S. Pat. Nos. 3,753,508; 3,984,016; 3,672,521; and 6,604,752, all of which are incorporated herein by reference in their entirety.

Figure 6:
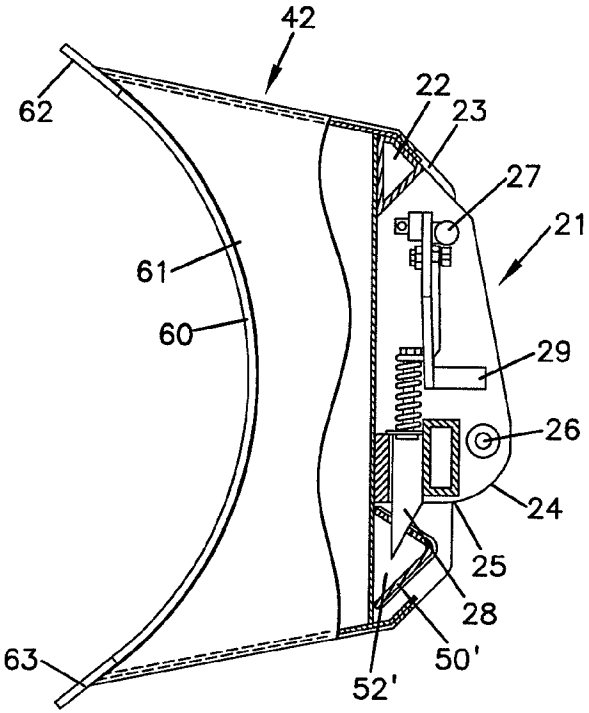
FIG. 6 is another left side elevation view of the loader attachment similar to FIG. 5, shown in combination with the attachment carrier of the skid steer loader of FIG. 1 in a secured orientation.
Figure 5:
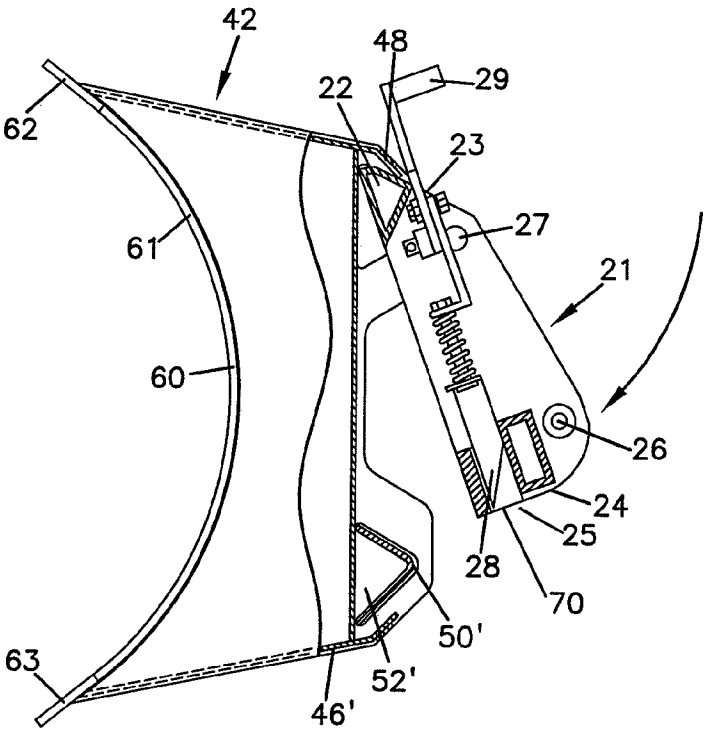
FIG. 5 is a left side elevation view of the loader attachment of FIG. 2, illustrated with a section of the reversible hitch structure cut-out to expose the internal details thereof, shown in combination with an attachment carrier of the skid steer loader of FIG. 1 in an unsecured orientation.
Figure 7:
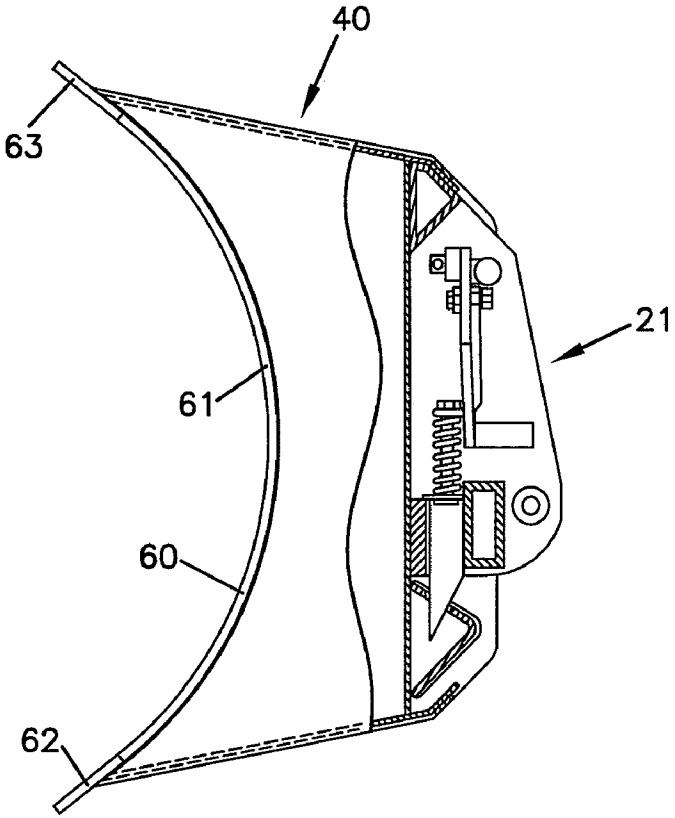
FIG. 7 is another left side elevation view of the loader attachment similar to FIG. 6, wherein the loader attachment is shown in an orientation that is 180° from that of FIG. 6.

Since attachment carriers can take various forms and configurations in the art, the attachment carrier 21 is illustrated in FIGS. 1, 5-7 in diagrammatic fashion, with only the key features shown. Referring to FIGS. 5-7, a preferred configuration of a typical attachment carrier 21 has a wedge shaped toe-like structure 22 adjacent its upper end 23 and a heel-like structure 24 adjacent its lower end 25. The attachment carrier 21 is pivotally connected at point 26 near the lower end 25 to the lift arms 14 of the skid steer vehicle 10. The cylinders 17 are connected to the attachment carrier 21 near its upper end 23 for tilting the attachment carrier 21 about point 27. The attachment carrier 21 includes a locking wedge 28 which can be operated by a hand lever 29 to raise and lower the locking wedge. In the extended position (shown in FIGS. 6 and 7), the wedge 28 projects through an opening 70 at the bottom end 25 of the attachment carrier 21. For simplicity's sake, the attachment carrier 21 is conveniently referred to as a toe-heel attachment carrier since it has a toe 22 and a heel 24 that are fundamental to its structure, whether by way of framing or by the use of solid metal material to create the toe and heel carrier features.

Since configurations and operations of such skid steer loader vehicles and attachment carriers found on these vehicles are well known in the art, further details thereof will not be provided herein, it being understood that those skilled in the art clearly understand the nature of such vehicles and how they operate in numerous versatile situations. Attachment and detachment of the attachment carrier 21 to and from the reversible hitch structure 40 of the invention will be described in greater detail further below.

Figure 2:
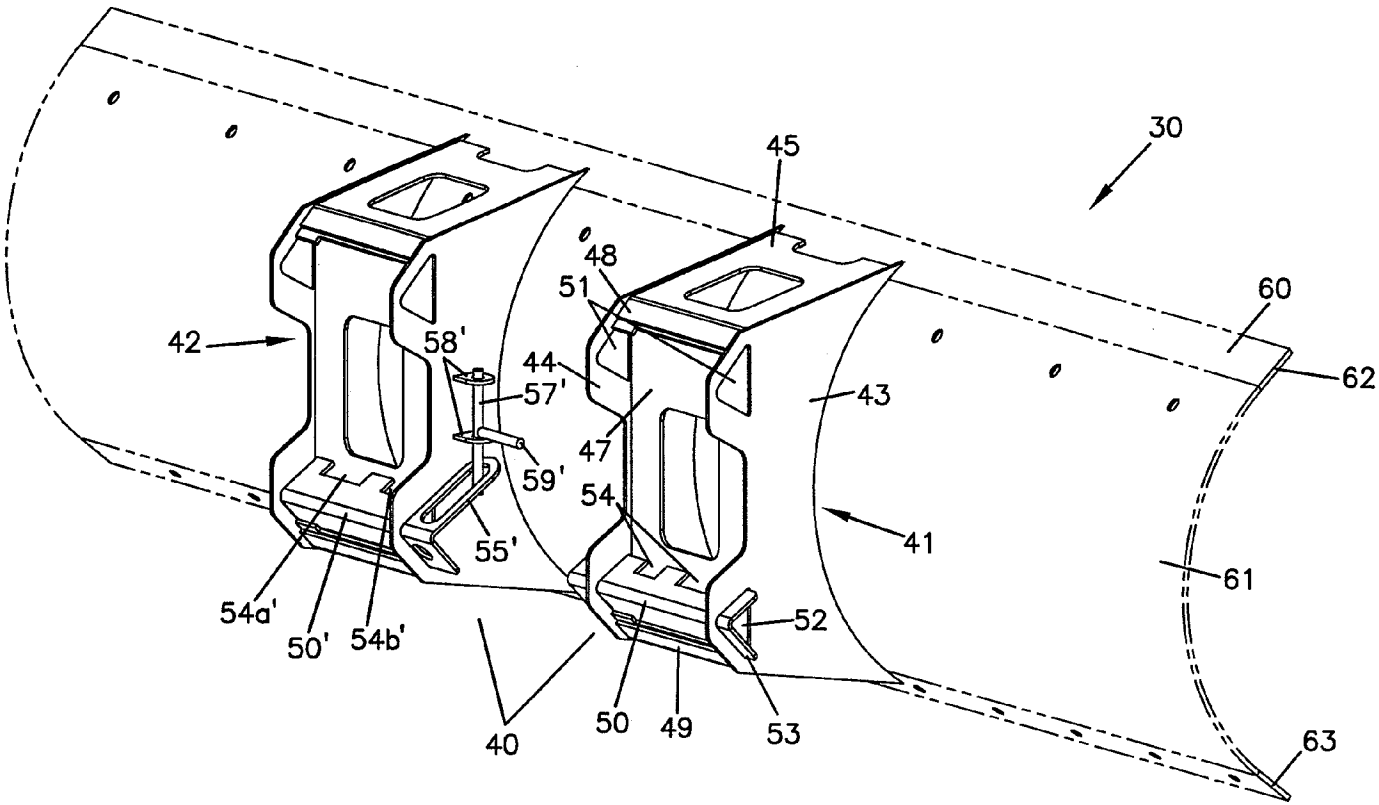
FIG. 2 is a right rear perspective view of the loader attachment of FIG. 1, including the plow blade workpiece of FIG. 1, shown with phantom lines, and the reversible hitch structure of FIG. 1 mounted to the plow blade workpiece.

Referring now to FIG. 2, a loader attachment 30 including a plow-blade workpiece 60 and the reversible hitch structure 40 of the present invention is illustrated in isolation from the skid steer vehicle 10. The plow-blade workpiece 60 is shown with phantom lines. The plow-blade workpiece includes a main body portion 61, an upper edge 62 and a lower edge 63. The upper edge 62 may be constructed of a different material than the lower edge 63. It shall be understood that the reversible hitch structure 40 of the present invention is not limited to use with the plow-blade workpiece 60 illustrated in the Figures, but that the plow blade 60 is simply representative of one embodiment of a loader attachment workpiece that can be attached to a loader vehicle with the use of the reversible hitch structure 40 of the present invention. Various kinds of other workpiece implements discussed above, such as bucket assemblies, fork lift members, clam shells, and the like, especially loader implements that can be used in a reversible manner, can be secured to a vehicle, such as the skid steer vehicle 10, with the use of the reversible hitch structure 40 of the present invention. Although depicted as being welded to the plow-blade workpiece 60 in the Figures, it shall be understood that the reversible hitch structure 40 of the present invention can be mounted to workpieces in various ways including by welding, with fasteners, etc.

The reversible hitch structure 40 of the present invention is shown in solid lines in FIG. 2. As shown in FIG. 2, the reversible hitch structure 40 is depicted as a universal hitch structure that is configured to be used in combination with those attachment carriers found in most conventional loader vehicles. It will be understood, however, that the universal type reversible hitch structure is simply one representative embodiment of the reversible hitch structure 40 incorporating the principles of the invention. The universality of the reversible hitch structure 40 will be discussed in further detail below.

As shown in FIG. 2, the reversible hitch structure 40 includes a right hitch structure 41 and a left hitch structure 42 that generally include corresponding structure. In certain embodiments, the reversible hitch structure 40 of the present invention may be configured of one solid piece instead of two separate pieces, as will be discussed further below.

The right hitch structure 41 and the left hitch structure 42 generally have similar structure, therefore the reversible hitch structure 40 of the present invention will be described with respect to only the right hitch structure 41, it being understood that the discussion applies equally to both the right and the left structures 41, 42. Corresponding structure, when identified, will be characterized on the left hitch structure 42 using the same reference number used on the right hitch structure 41, except that the reference numerals identifying corresponding structure on the left hitch structure 42 will include an apostrophe or prime designation.

The reversible hitch structure 41 includes a first sideplate 43 and a second side plate 44. The reversible hitch 41 also includes a top plate 45, a bottom plate 46 (shown in FIG. 3), and a face plate 47 disposed between and separating the side plates 43, 44. Adjacent the top and bottom plates 45, 46 of the reversible hitch structure 41 are top and bottom locking structures 48 and 49. The top and bottom locking structures 48 and 49 are disposed between the sideplates 43, 44 and protrude at an angle from the top and bottom plates 45 and 46, respectively, to form receptor channels for matingly engaging the toe portion of the attachment carrier, as hereinafter described in more detail. The top and bottom locking structures 48 and 49 include similar structure and are constructed to provide reversibility for the hitch structure 41 of the present invention, as will be described further below.

The top and bottom locking structures 48 and 49 are depicted in the Figures as latching ledges that are universal and are configured to engage the toe-like structure 22 of the attachment carrier 21 found in most of the conventional loader vehicles. In certain other embodiments, the top and bottom locking structures may include different configurations.

As illustrated in FIG. 2, the reversible hitch structure 41 includes a removable locking structure 50 at the opposite end from the top locking structure 48. The removable locking structure 50 is depicted as a key with slots, but may include different configurations in other embodiments. The removable locking structure 50 is configured to be slidably received within either the upper or lower triangular key holes 51, 52 defined in the first and second sideplates 43 and 44. Either the upper or the lower key holes, 51, 52 are utilized depending upon the desired orientation of the loader implement. In the preferred embodiment, the removable locking structure 50 is depicted as a key with slots that are adapted to interfit with the locking wedge of a universal attachment carrier. Along with either the top or the bottom latching ledges, the locking structure 50 forms a universal hitch structure for attaching loader attachments to loader vehicles that contain a universal attachment carrier.

The removable locking structure 50, along with the similarly configured top and bottom locking structures 48 and 49, provides a way to make the hitch structure a reversible hitch structure because it can be slid out of the lower key holes 52 and placed in the upper keyholes 51 after the implement has been rotated 180°.

The removable locking structure 50 includes a V-shaped cross-section 53 that prevents the removable locking structure 50 from rotating once received within the triangular key holes 51, 52. As discussed previously, the removable locking structure 50 includes latching slots 54, each of which is adapted to receive a locking wedge 28 of the attachment carrier 21 to lock the attachment carrier to the reversible universal hitch structure 41. The removable locking structure 50 also includes a handle 55 used to insert the removable locking structure 50 into the key holes 51-52.

In FIG. 2, only handle 55' of the left removable locking structure 50' of the left hitch structure 42 can be seen. The handle 55 is configured with a handle slot 56. A pin 57, slidably attached to the second sideplate 44 of the hitch structure 41 by brackets 58, is used to engage the handle slot 56 and prevent the removable locking structure 50 from sliding out when not engaged by the loader attachment carrier. In FIG. 2, the pin 57' and the brackets 58' of only the left hitch structure 42 can be seen. When desired, using the pin handle 59, the pin 57 can be lifted and moved out of the handle slot 56 to allow slidable removal of the locking structure 50 out of the key holes 51-52.

As depicted in the Figures, the removable locking structure 50 includes a larger (wider) latching slot 54*a* and a smaller (narrower) latching slot 54*b*. The different sized slots provide universality to the hitch structure since it is known in the art that certain loader vehicles contain wider attachment carriers and contain locking wedges that are spaced further apart than those of certain other manufacturers of loader vehicles.

One way in which the reversible hitch structure of the invention can be used in combination with loader vehicles is illustrated in FIGS. 5-7. In FIGS. 5-7, the left hitch structure 42 is shown in fragmented fashion, with a portion cut-out, along with the attachment carrier 21, and illustrates operation of the invention. In operation, the operator of the loader vehicle manipulates the toe 22 of the attachment carrier of the loader vehicle until it cooperatively matingly engages the top locking structure 48' of the hitch 42. The operator then, using the cylinders 17 and lift arms 14 of the vehicle 10, starts to lift the implement and pivots the bottom of the attachment carrier toward bottom plate 46' of the hitch structure 42 until the attachment carrier 21 abuts the faceplate 47', as depicted by the arrow in FIG. 5. Once the attachment carrier abuts against the faceplate 47' of the hitch structure 42 and the heel 24 of the attachment carrier 21 is resting adjacent the latching slots 54' of the removable locking structure 50', the operator rotates the lever 29 of the attachment carrier 21 lowering and locking the wedges 28 within the latching slots 54' of the removable locking structure 50'. In this manner, the implement is securely locked onto the attachment carrier of the vehicle 10. The triangular shaped lower key holes 52' along with the shape of the removable locking structure 50' prevent any rotation of the removable locking structure 50' within the key holes 52', and the wedges 28 penetrating through the latching slots 54' prevent any lateral movement of the removable locking structure 50' within the key holes 52'.

If use of the reverse side of an implement is desired, the operator detaches the attachment carrier from the hitch 42, removes the pin 57' from the handle 55', slides the removable locking structure 50' out of its retaining slots 52', reverses the implement by rotating it 180°, and then slides the removable locking structure 50' into the keyholes 51 located on the opposite side. The same procedure is mirrored for removal and reinsertion of the removable locking structure 50.

If the loader attachment is small enough in size and weight, the operator can simply manually rotate the implement around 180°. However, if the implement is of substantial size, such as the plow-blade workpiece 60 illustrated in the Figures, a different procedure is recommended. The operator can simply pivot the plow blade 60 down using the cylinders 17 and lay it on the ground face down. The operator can then pull the attachment carrier 21 away from the hitch structure 40 after disengaging the locking wedges 28 from the latching slots 54, 54' and the toe 22 from the top locking structures 48, 48' of the hitch 40. The operator can then slide the removable locking structures 50 and 50' out of the right and left hitch structures 41 and 42 after disengaging the pins 57 and 57'. The right removable locking structure 50 can then be inserted into the upper key holes 51' of the left hitch structure 42 and the left removable locking structure 50' can be inserted into the upper key holes 51 of the right hitch structure 41. The vehicle 10 can then be driven around the implement and after making a U-turn, the vehicle 10 can engage the implement from the opposite edge.

Figure 3:
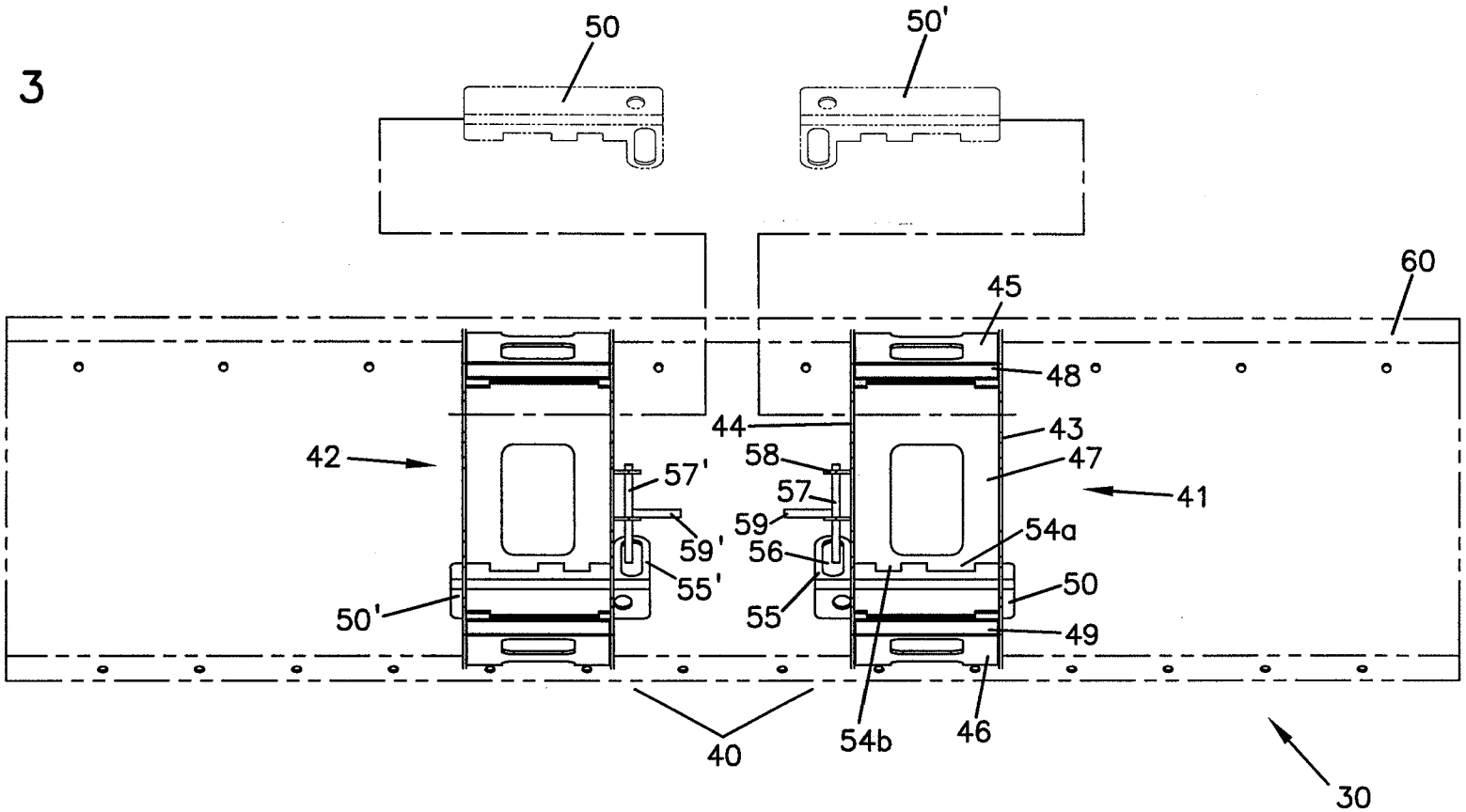
FIG. 3 is a back view of the loader attachment of FIG. 2, wherein the insertion paths of the removable locking structures of the reversible hitch structure when the loader attachment is to be reversed is shown with phantom lines.
Figure 4:
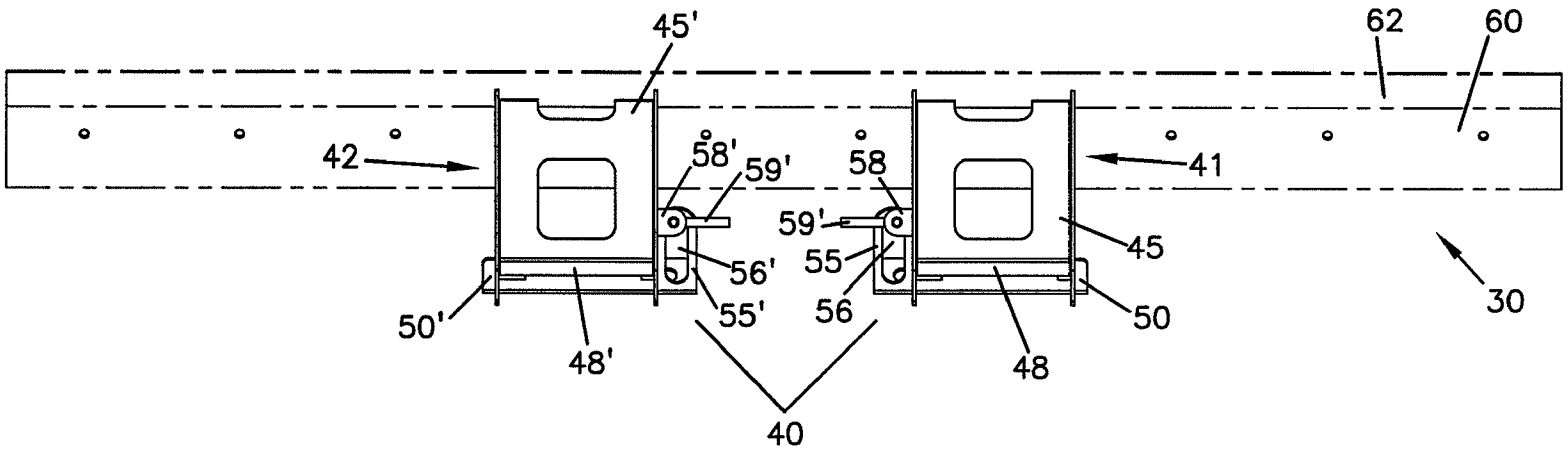
FIG. 4 is a top view of the loader attachment of FIG. 2.

It should be noted that in the embodiment of the right and left hitch structures 41 and 42 depicted in the Figures, the removable locking structure 50 and 50' only have a handle on one side of the removable locking structure and a pin is located on only the second sideplates, as shown in FIGS. 3 and 4. Therefore, the removable locking structure 50 from the right hitch structure 41 must be taken out of the lower key holes 52 of the right hitch structure 41 and be inserted into the upper keyholes 51' of the left hitch structure 42 making sure the handle 55 ends up on the same side as the pin 57' as demonstrated in phantom in FIG. 3. The same must be done with the removable locking structure 50' of the left hitch structure 42. The pin is long enough to be utilized to lock the handle when the removable locking structure is inserted in either the lower keyholes 52 or the upper keyholes 51. Once the removable locking structures are flipped and inserted into opposite key holes, the same operation can be followed to engage the implement as was discussed previously. In FIG. 7, the plow-blade workpiece is shown in an orientation that is 180° from that of FIG. 6 after having been reversed.

It should also be understood that, although the hitch structures depicted in the Figures are configured with a pin assembly on only one plate of the hitch structure, other embodiments are contemplated wherein pins are located on both sideplates of the right and left hitch structures, 41, 42. In such embodiments, the right removable locking structure can be reinserted into the keyholes of the right hitch structure and the left removable locking structure can be inserted into the key holes of the left hitch structure, making sure the latching slots are oriented correctly. It is also contemplated that other embodiments may include latching slots or handles defined on both legs of the V-shape of the removable locking structure, dimensioning the sizes and shapes of the slots accordingly. In those embodiments, the removable locking structures may simply be reinserted into the key holes from the same side from which they were removed.

Figure 8:
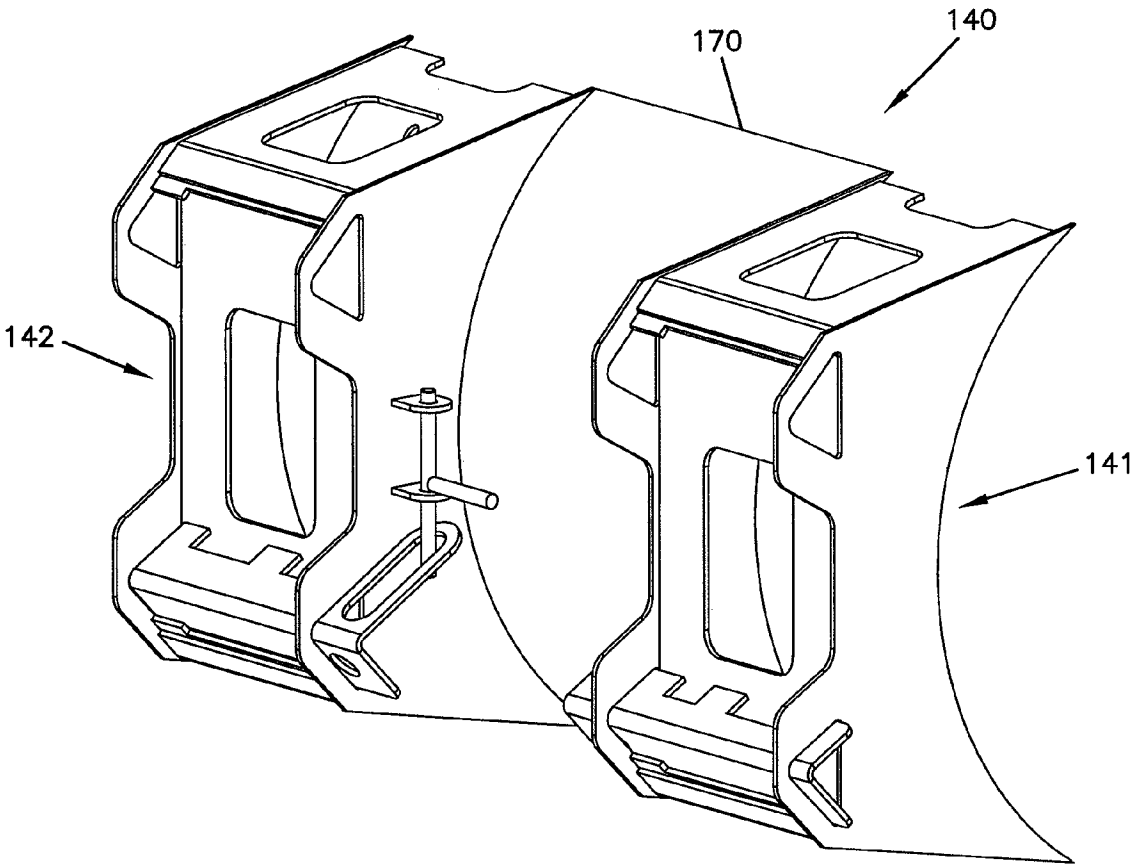
FIG. 8 is a right rear perspective view of another embodiment of a reversible hitch structure incorporating the principles of the invention.

In FIG. 8, another embodiment of a reversible universal hitch structure 140 incorporating the principles of the invention is shown. This embodiment of the reversible hitch structure includes a generally one-piece construction wherein the right and left hitch structures 141 and 142 are integrally formed with a connection plate 170 interposed therebetween rather than as separate structures that have to be welded onto the workpiece. The connection plate 170 can be used to connect the hitch structure 140 to the workpiece. It will be understood that the hitch structure can take many forms or shapes within the spirit of the invention. For example, in certain embodiments, one long removable locking structure including a single handle instead of two separate removable locking structures with two handles can be used to make the hitch structure reversible and, when desired, universal. In certain other embodiments, one long top or bottom locking structure can be used instead of two separate locking structures wherein the inner sideplates may be eliminated.

Any combination of these variations can be utilized. The shapes and the sizes of the plates of the hitch structure can vary according to the loader attachment workpiece that is used so long as the reversibility of the hitch structure according to the invention is preserved. It will be understood that many variations of the hitch structure of the present invention can be utilized, including, for example, variations which do not require a sliding motion for engaging the reversible locking feature, without departing from the spirit of the invention.

It should also be understood that the top and bottom locking structures 48 and 49 of the hitch structure 41 may be used without the use of a removable locking structure 50 and still provide for full reversibility for the attachment. Since the top and bottom locking structures 48 and 49 include similar structure, they can provide reversibility for the hitch structure 41 of the present invention. The top and bottom locking structures 48 and 49 are disposed between the sideplates 43, 44 and protrude at an angle from the top and bottom plates 45 and 46, respectively, to form receptor channels for matingly engaging portions of an attachment carrier. An attachment carrier that is designed to have a first and a second oppositely disposed coupling members may be coupled to the hitch structure 41 by engaging the receptor channels defined by the top and bottom locking structures 48, 49. And if desired, since the top and bottom locking structures 48, 49 have similar structure, the attachment carrier can be reversed and remounted to the hitch structure. It should be understood that a removable locking structure 50 may be used in combination with the top and bottom locking structures 48, 49 if a universal toe/heel type of an attachment carrier that is found on most skid steer type loaders is utilized. Otherwise, a removable locking structure 50 may not be needed if a different type of an attachment carrier is utilized.

Although in the foregoing description of the reversible hitch structure 40, terms such as "top", "bottom", "upper", "lower", "front", "back", "right", and "left" were used for ease of description and illustration, no restriction is intended by such use of the terms. The reversible hitch structure 40 can be used in any orientation.

It will be appreciated that while a preferred embodiment, description and application of the invention has been disclosed, other modifications of the invention not specifically disclosed or referred to herein will be apparent to those skilled in the art in light of the foregoing description. This invention is intended to provide a specific example of a preferred embodiment structure and application which clearly discloses the apparatus and method of the present invention and its operative principles. Accordingly, the invention is not limited to any particular embodiment or configuration or component parts thereof or to the used of any particular materials for their construction. All alternatives, modifications, and variations of the present invention which fall within the spirit and broad scope of the appended claims are covered.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A hitch structure for mounting an attachment to a loader vehicle of the type having a toe/heel type attachment carrier, the hitch structure comprising:

(a) a first end positioned opposite a second end;

(b) a fixed locking structure located adjacent each of the first end and the second end, the fixed locking structure at each of said first and second ends being independently configured to receive the toe end of the attachment carrier of the loader vehicle; and (c) a removable locking structure including a slot for receiving the heel end of the attachment carrier of the loader vehicle;

(d) wherein the removable locking structure is removably engageable with the hitch structure alternatively adjacent either the first end or the second end of the hitch structure to form a clamping structure with the fixed locking structure located at the opposite end from the removable locking structure for mounting the attachment to the loader.

2. A hitch structure according to claim 1, wherein the removable locking structure includes a key with universal latching slots.

3. A hitch structure according to claim 1, wherein the removable locking structure is slidably disposed with respect to the hitch structure.

4. A hitch structure according to claim 3, further including a locking mechanism for fixedly coupling the removable locking structure to the hitch structure to prevent the removable locking structure from sliding off from the hitch structure.

5. A loader vehicle attachment constructed for mounting to a front side of the loader vehicle, the attachment comprising:

(a) a workpiece defining a working surface configured to extend in a first direction with respect to the loader vehicle when the workpiece is mounted to the front side of the loader vehicle; and (b) a hitch structure connected to the workpiece, the hitch structure being configured to removably connect the workpiece to the front side of the loader vehicle, the hitch structure being configured to enable connection of the workpiece to the loader vehicle in either of two orientations, the orientations being up to 180° from each other, wherein the working surface of the workpiece is configured to extend in the first direction when the workpiece is mounted in either of the two orientations, wherein the hitch structure includes:

(i) a first end positioned opposite a second end;

(ii) a fixed locking structure located adjacent each of the first end and the second end; and (iii) a removable locking structure constructed to be coupled adjacent either the first end or the second end;

(iv) wherein the removable locking structure is removably engageable with the hitch structure alternatively adjacent either the first end or the second end of the hitch structure to cooperatively form a clamping arrangement with the fixed locking structure located at the opposite end from the removable locking structure for connecting the workpiece to the loader vehicle such that the workpiece can be mountable in either of the two orientations up to 180° from each other;

whereby the workpiece can alternatively be used in the two different orientations.

6. A loader vehicle attachment according to claim 5, wherein the workpiece includes a plow blade.

7. A loader vehicle attachment according to claim 5, wherein the removable locking structure includes universal latching slots.

8. A loader vehicle attachment according to claim 5, wherein the removable locking structure is slidably disposed with respect to the hitch structure.

9. A loader vehicle attachment according to claim 8, further including a locking mechanism for fixedly coupling the removable locking structure to the hitch structure to prevent the removable locking structure from sliding off from the hitch structure.

10. An attachment assembly for mounting an attachment to a loader type vehicle of the type having an attachment carrier mounted to the front side of the loader vehicle, the attachment carrier having first and second oppositely disposed coupling members, the attachment assembly comprising:

(a) an attachment constructed for mounting on the attachment carrier, the attachment including:

(i) a workpiece; and (ii) a hitch structure connected to the workpiece, the hitch structure configured to removably connect the workpiece to the attachment carrier, the hitch structure being configured to enable connection of the workpiece to the attachment carrier in either of two orientations, the orientations being up to 180° from each other, wherein the hitch structure includes a first end positioned opposite a second end, a first locking structure located adjacent said first end and a second locking structure located adjacent said second end, said first locking structure configured to cooperatively mate with said first coupling member of the attachment carrier and said second locking structure configured to cooperatively mate with said second coupling member of the attachment carrier;

whereby the workpiece can alternatively be used in two different orientations.

11. An attachment assembly according to claim 10, wherein the workpiece includes a plow blade.

12. An attachment assembly according to claim 10, further including a third locking structure wherein said third locking structure is configured to be detachably mounted to said hitch structure.

13. An attachment assembly according to claim 12, wherein the detachable third locking structure is operatively engagable with the hitch structure alternatively adjacent either said first end or said second end of the hitch structure to cooperatively form with either said first locking structure or said second locking structure a clamping arrangement therebetween, for said first and second coupling members of said attachment carrier.

14. An attachment assembly according to claim 12, wherein the detachable third locking structure includes universal latching slots.

15. An attachment assembly according to claim 13, wherein the detachable third locking structure is slidably disposed with respect to the hitch structure.

16. An attachment assembly according to claim 15, further including a lock to fixedly couple the detachable third locking structure to the hitch structure to prevent the detachable third locking structure from sliding off from the hitch structure.

17. A loader vehicle attachment constructed for mounting to a front side of the loader vehicle, the attachment comprising:

(a) a workpiece; and (b) a hitch structure connected to the workpiece, the hitch structure being configured to removably connect the workpiece to the loader vehicle, the hitch structure being configured to enable connection of the workpiece to the loader vehicle in either of two orientations, the orientations being up to 180° from each other; whereby the workpiece can alternatively be used in the two different orientations, the hitch structure further comprising:

(i) a first end positioned opposite a second end;

(ii) a fixed locking structure located adjacent each of the first end and the second end; and (iii) a removable locking structure constructed to be coupled adjacent either the first end or the second end;

(iv) wherein the removable locking structure is removably engageable with the hitch structure alternatively adjacent either the first end or the second end of the hitch structure to cooperatively form a clamping arrangement with the fixed locking structure located at the opposite end from the removable locking structure for connecting the workpiece to the loader vehicle such that the workpiece can be mountable in either of the two orientations up to 180° from each other.

18. A loader vehicle attachment according to claim 17, wherein the removable locking structure includes universal latching slots.

19. A loader vehicle attachment according to claim 17, wherein the removable locking structure is slidably disposed with respect to the hitch structure.

20. A loader vehicle attachment according to claim 19, further including a locking mechanism for fixedly coupling the removable locking structure to the hitch structure to prevent the removable locking structure from sliding off from the hitch structure.

21. A loader vehicle attachment according to claim 17, wherein the workpiece includes a plow blade.

* * * * *